US010192409B2

(12) United States Patent
Schmidt et al.

(10) Patent No.: US 10,192,409 B2
(45) Date of Patent: Jan. 29, 2019

(54) PORTABLE PANIC ALARM

(71) Applicants: Donald M. Schmidt, Fort Myers, FL (US); Ronald J. Sargent, Pompano Beach, FL (US)

(72) Inventors: Donald M. Schmidt, Fort Myers, FL (US); Ronald J. Sargent, Pompano Beach, FL (US)

( * ) Notice: Subject to any disclaimer, the term of this patent is extended or adjusted under 35 U.S.C. 154(b) by 0 days.

(21) Appl. No.: 15/784,382

(22) Filed: Oct. 16, 2017

(65) Prior Publication Data

US 2018/0122195 A1 May 3, 2018

Related U.S. Application Data

(60) Provisional application No. 62/408,173, filed on Oct. 14, 2016.

(51) Int. Cl.

| | |
|---|---|
| ***G08B 3/02*** | (2006.01) |
| ***G08B 15/00*** | (2006.01) |
| ***G08B 3/10*** | (2006.01) |

(52) U.S. Cl.

CPC ..... *G08B 3/02* (2013.01); *G08B 3/10* (2013.01); *G08B 15/004* (2013.01)

(58) Field of Classification Search

CPC ... G08B 3/02; G08B 7/00; G08B 7/04; G08B 15/00; G08B 15/004

USPC ..... 116/77, 99, DIG. 44

See application file for complete search history.

(56) References Cited

U.S. PATENT DOCUMENTS 4,404,549 A * 9/1983 Berg ..... G08B 15/004 340/321
4,968,034 A * 11/1990 Hsieh ..... F21V 33/0076 231/7
5,086,377 A * 2/1992 Roberts ..... F21V 33/0064 222/113
5,475,368 A * 12/1995 Collins ..... G08B 15/004 340/391.1
5,549,220 A * 8/1996 Whalen ..... B05B 9/0805 116/81
5,847,652 A * 12/1998 Yamamoto ..... G08B 15/004 340/574
5,893,483 A * 4/1999 Duran ..... F41H 9/10 206/38.1
5,903,219 A * 5/1999 Chen ..... G08B 21/0297 200/50.31

(Continued)

FOREIGN PATENT DOCUMENTS

GB 1199816 A * 7/1970 ..... F21V 33/00
GB 2310063 A * 8/1997 ..... G08B 15/004

*Primary Examiner* — R. A. Smith
(74) *Attorney, Agent, or Firm* — William E. Noonan

(57) ABSTRACT

A portable panic alarm assembly includes a housing and an audible alarm device mounted within the housing. The alarm device is electrically and operably interconnected between first and second alarm contacts. A battery mounted within the housing has a pair of oppositely charged electrodes. A first electrode is connected to the first alarm contact. An actuator switch is slidably mounted in the housing and includes an actuator contact. The actuator switch is operably alternated between an open state, wherein the second battery electrode is disconnected from the second alarm contact to deactivate the alarm and a closed state, wherein the second battery electrode is connected to the second alarm contact to activate and sound the alarm.

20 Claims, 8 Drawing Sheets

(56) References Cited

U.S. PATENT DOCUMENTS 5,923,255 A * 7/1999 Vandatshoar ..... G08B 21/0288
340/573.1

* cited by examiner

PORTABLE PANIC ALARM

FIELD OF THE INVENTION

This invention relates to a panic alarm that is compact and conveniently portable. The panic alarm is reliably actuated by a mechanical trigger that may be pressed and released to produce a loud panic signal.

BACKGROUND OF THE INVENTION

Conventional panic alarms are widely employed in buildings and vehicles. However, known portable panic alarms typically exhibit one or more shortcomings. Many of these devices feature an unduly complicated construction and can be difficult to reliably access and operate, which can be a serious problem in the event of an emergency. Some portable panic alarms are embedded in or attached to articles such as children's toys and stuffed animals, wrist watch bands and key chains. This makes the alarm difficult to conceal and may also make it less compact and portable. Many conventional panic alarms employ fairly complex electronic circuitry, which can complicate the manufacture and significantly increase the expense of the device.

A number of other portable panic alarms are activated by a button or switch that may be pressed and held in order for the device to emit a continuous audible alarm signal. In the event of an attack, break-in or other emergency, the user may drop the alarm device, which can render such press and hold devices inoperable.

Still other panic alarms utilize wireless communication systems. In the event of an emergency, the device is activated to send a wireless alarm signal either directly or through a monitoring station to police, fire or emergency rescue personnel. Although such systems provide significant benefits, they typically do not produce a loud and/or piercing emergency alarm signal and are therefore less effective when the user is faced with an attacker or intruder and cannot afford any delays summoning help.

SUMMARY OF THE INVENTION

It is therefore an object of the present invention to provide a compact, conveniently portable and easy to operate panic alarm.

It is a further object of this invention to provide a portable panic alarm that employs a very simple construction and which may be quickly, easily and dependably operated in the event of an attack, intrusion or other emergency to produce a loud, audible emergency signal.

It is a further object of this invention to provide a portable panic alarm that may be quickly and reliably activated when needed by simply pressing an actuator component that is then held mechanically in place so that a continuous panic signal is sounded without the user having to continue to press and hold the actuator.

It is a further object of this invention to provide a battery operated portable panic alarm that effectively closes and conceals the alarm within the body of the device so that is more time consuming and difficult for an attacker or an intruder to remove the battery and disable the alarm.

It is a further object of this invention to provide a portable panic alarm that remains effectively activated and that continue to emit an audible emergency alarm signal even when the panic alarm is dropped by the user.

It is a further object of this invention to provide a portable panic alarm that a user may conveniently carry in assorted locations in the user's clothing or in a bag, case, backpack, or other accessory that the user is carrying.

It is a further object of this invention to provide a panic alarm device featuring an effective and reliable ON/OFF actuator switch that is turned off in a manner not likely to be apparent to an attacker or intruder and which would thus, in most cases, delay deactivation of the alarm and prolong the emission of an audible emergency alarm signal so that help is effectively summoned and/or the emergency is successfully resolved.

This invention features a portable panic alarm assembly including a housing that holds an electrically operated audible alarm device. The alarm device is electrically and operably interconnected between first and second alarm contacts. A battery power source is also mounted within the housing and includes a pair of oppositely charged electrodes. A first electrode is connected to the first alarm contact. An actuator switch includes a slide component mounted slidably in the housing and an actuator contact carried by the slide component. The actuator switch is selectively alternated between an open state wherein a second electrode is electrically disconnected from the second alarm contact to deactivate the alarm device and a closed state wherein the actuator contact electrically interconnects the second electrode and the second alarm contact to activate the alarm device.

In a preferred embodiment, the housing may include a pair of half sections that are molded in a configuration to compactly receive and accommodate the battery, alarm device, actuator switch and other internal operating components of the alarm assembly. The half sections of the housing may be snap-fit together and held in place by fastening pins. The half sections may be sonically welded, glued or otherwise attached in acceptable known ways. A belt clip may be formed unitarily with the housing. A hole or receptacle for accommodating a strap or lanyard may be formed through the belt clip.

The alarm device may include a piezo electric siren mounted snugly within the housing. The first alarm contact may be attached to the alarm device and extend across an upper surface thereof. One electrical terminal (i.e. typically a negative terminal) of the alarm device may be soldered or otherwise electrically connected by a first wire lead to the first alarm contact. The first alarm contact may also include a spring contact portion that extends upwardly from the first alarm contact for interengaging the first electrode of the battery. Preferably, the battery comprises a 12-volt cylindrically-shaped battery having a first negative electrode at the lower end thereof and a second, positive electrode formed at the upper end thereof. The second alarm contact may include an elongate, electrically conductive contact portion that is mounted within a mounting slot formed interiorly within the housing. The second alarm contact may further include a spring arm that extends upwardly from an upper end of the elongate electrically conductive contact portion at an angle thereto. A lower end of the elongate electrically conductive contact portion may itself be electrically interconnected by a second wire lead to a second, typically positive terminal of the alarm device.

The slide component of the actuator switch may include an elongate slide carriage that is slidably received within a transverse passageway formed through the housing. The half sections may be sonically welded, glued or otherwise attached in acceptable known ways. An actuator button is attached integrally at an outer end of the carriage. The button may be pressed using finger force to push the carriage transversely through the transverse passageway. Alternately, the carriage may be pulled transversely outwardly through the transverse passageway by pulling the actuator button outwardly. The actuator contact includes a flat, electrically conductive plate and a pair of legs that are received in corresponding attachment slots formed in the carriage. This secures the actuator contact to a lower surface of the slide carriage. A retainer member may be mounted to an upper surface of the carriage to hold the actuator contact in place with its flat conductive plate held flush against the bottom surface of the carriage. In such embodiments, the actuator contact is sized, constructed and positioned such that operating the slide component causes the actuator switch to selectively open and close the electrical circuit that operates the panic alarm. Specifically, the actuator contact is supported such that it is slidably engageable across the upper second electrode of the battery and the spring arm formed at the upper end of the second alarm contact. Accordingly, when the button is pulled and the slide carriage is slid outwardly from the housing, the conductive plate of the actuator contact disengages the second or positive electrode of the battery. This opens the circuit and as a result the alarm is deactivated. Alternatively, when the button is pressed and the slide element is pushed fully into the housing, the actuator control interengages both the second electrode and the second alarm contact. This closes the circuit and causes the alarm to be activated.

The slide component of the actuator switch and the transverse passageway in which the slide component is received include additional features that provide for a more reliable and problem-free operation. In particular, the transverse passageway preferably includes a pair of carriage retention notches formed in a lower surface of the transverse passageway proximate an inner end thereof. The slide component may include a corresponding tooth-shaped detent that is formed on a bottom surface of the slide carriage. In the open state, with the slide component pulled outwardly of the transverse passageway, the detent is received in the outermost notch such that the actuator switch is held securely in place in an open state until actuating finger pressure is applied to push the actuator switch forwardly through the transverse passageway. Application of sufficient pressure causes the detent to slide out of the outer notch and drives the carriage and detent inwardly through the transverse passageway until the detent engages the second, innermost notch, which is typically formed at or proximate the inner end of the transverse passageway. When the detent is received by this notch, the actuator switch is pushed fully into the housing and is held securely in place by interengagement of the detent and the innermost notch. This holds the actuator switch securely and dependably in place with the actuator contact operably interconnecting the second electrode to the second alarm contact. As a result, the audible alarm remains reliably activated unless and until the user pulls the slide component outwardly by re-engaging and pulling the actuator button. In that case, the detent is pulled out of the innermost notch and the slide component slides outwardly until the detent re-engages the outer notch. The switch actuator is then held in an open condition wherein the actuator contact disengages the upper, second electrode of the battery and the alarm is deactivated.

The housing and/or the spring arm of the second alarm contact may be constructed to prohibit removal of the detent from the passageway and housing. As a result, the slide component and switch actuator are restricted from being disconnected from the housing. The transverse passageway may include an entry aperture for introducing a tool into the housing that is used to depress the spring arm so that the slide carrier and its depending detent may be removed past the depressed spring arm and through the entry aperture to fully remove the switch actuator from the housing, if desired.

A battery cover may be employed for selectively concealing and providing access to the battery compartment so that the battery may be conveniently replaced as needed. In particular, the housing may include an upper cover slot formed transversely to and above the transverse passageway for receiving the battery cover. Opposing openings may be formed in the housing at respective ends of the upper slot for receiving the battery cover. These openings are sized to receive a thin coin, such as a dime, for facilitating removal of the battery cover as needed.

BRIEF DESCRIPTION OF THE DRAWINGS

Other objects, features and advantages will occur from the following description of a preferred embodiment and the accompanying drawings, in which.

DETAILED DESCRIPTION OF PREFERRED EMBODIMENTS

Figure 3:
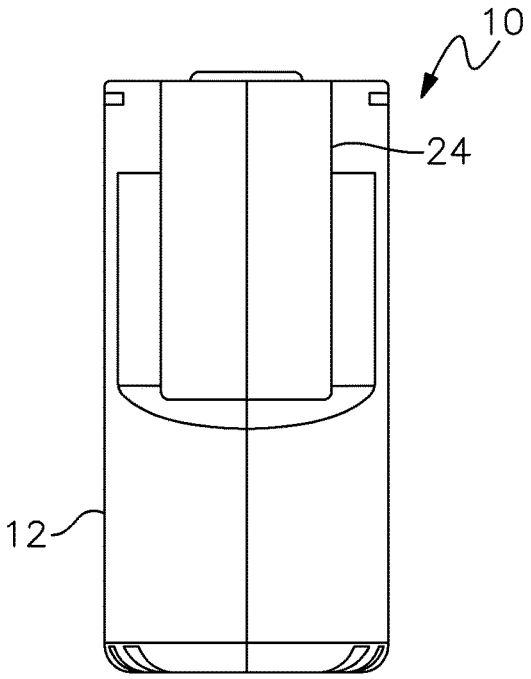
FIG. 3 is an elevational front view of the assembly.
Figure 4:
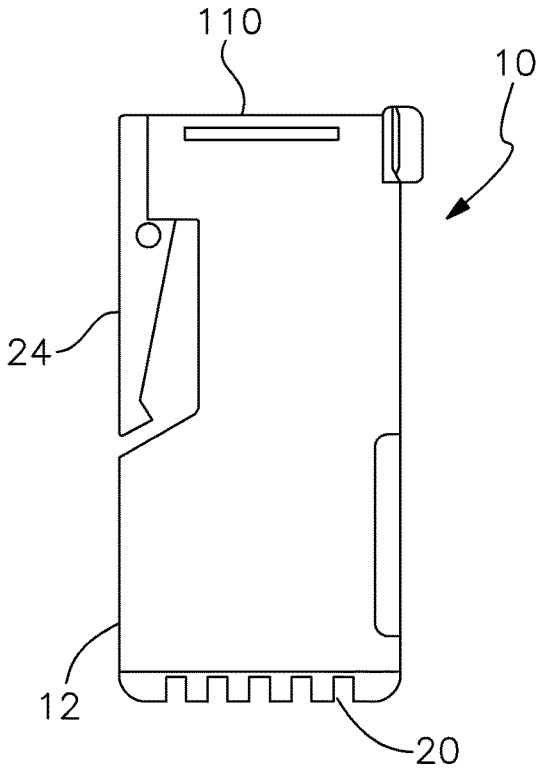
FIG. 4 is an elevational side view of the assembly.

There is shown in FIGS. 1-5 a portable panic alarm assembly 10 in accordance with this invention. The panic alarm has a cylindrical shape and a fairly compact size which enables it to be conveniently carried by a person either in their clothing or in a handbag, suitcase, purse, backpack or other accessory or carrying item. Representative dimensions (in inches) are shown in FIG. 4, however these are exemplary only and may be varied within the scope of this invention.

Assembly 10 includes a generally cylindrical housing 12 that may be composed of various lightweight and durable plastics. As better shown in FIG. 6, housing 12 typically comprises a pair of half sections 14 and 16 that may be joined by various manufacturing techniques. For example, housing half section 14 may include fastening pins 17, shown in FIG. 7, and half section 16 may include complementary pin receptacle slots (not shown). The half sections may be sonically welded, adhesively joined or otherwise fastened together in a number of acceptable ways within the scope of this invention.

Figure 1:
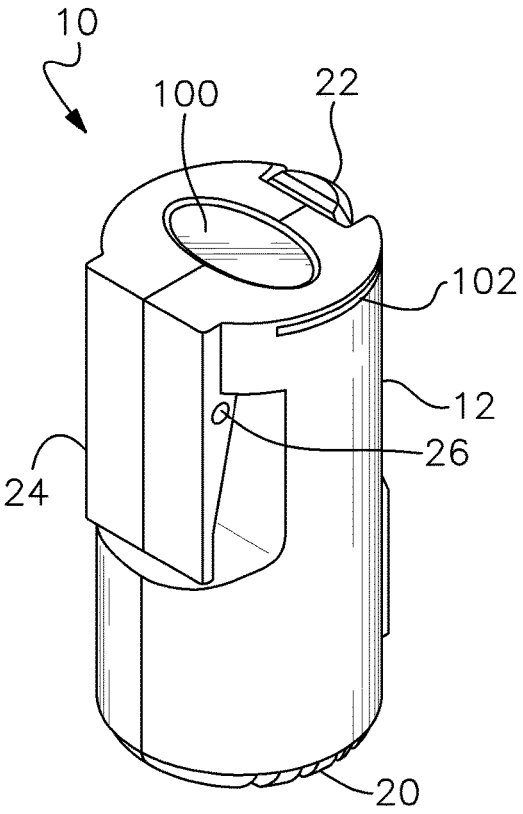
FIG. 1 is a perspective view of the portable panic alarm assembly of this invention.
Figure 2:
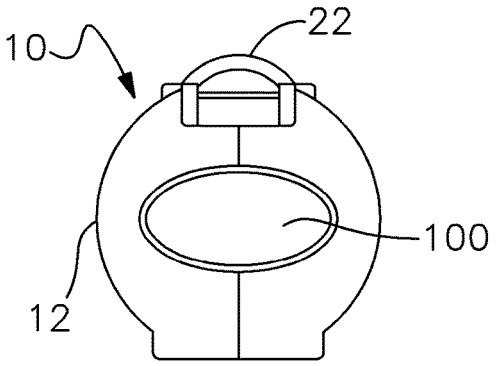
FIG. 2 is a top plan view of the portable panic alarm assembly.

As best shown in FIGS. 1 and 4, the lower end of housing 12 includes slots 20 for emitting a loud and piercing panic alarm sound produced by the audible alarm device accommodated within housing 12. The alarm device is described more fully below. At the opposite upper end of housing 12, an actuator switch is operably mounted for selectively activating and deactivating the audible alarm device. Again, this component is described more fully below. A belt clip 24 is molded unitarily with the half sections of housing 12. A transverse hole 26 may be formed through belt clip 24 for accommodating a lanyard or strap that allows the panic alarm to be conveniently secured to a user's belt, handbag or other clothing item or accessory.

Figure 5:
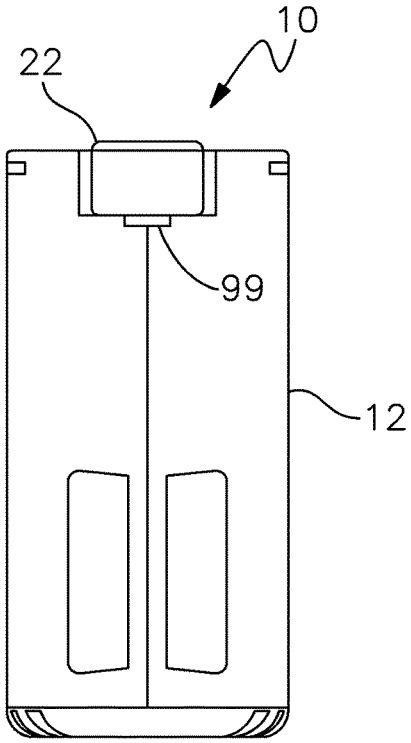
FIG. 5 is an elevational rear view of the assembly.
Figure 6:
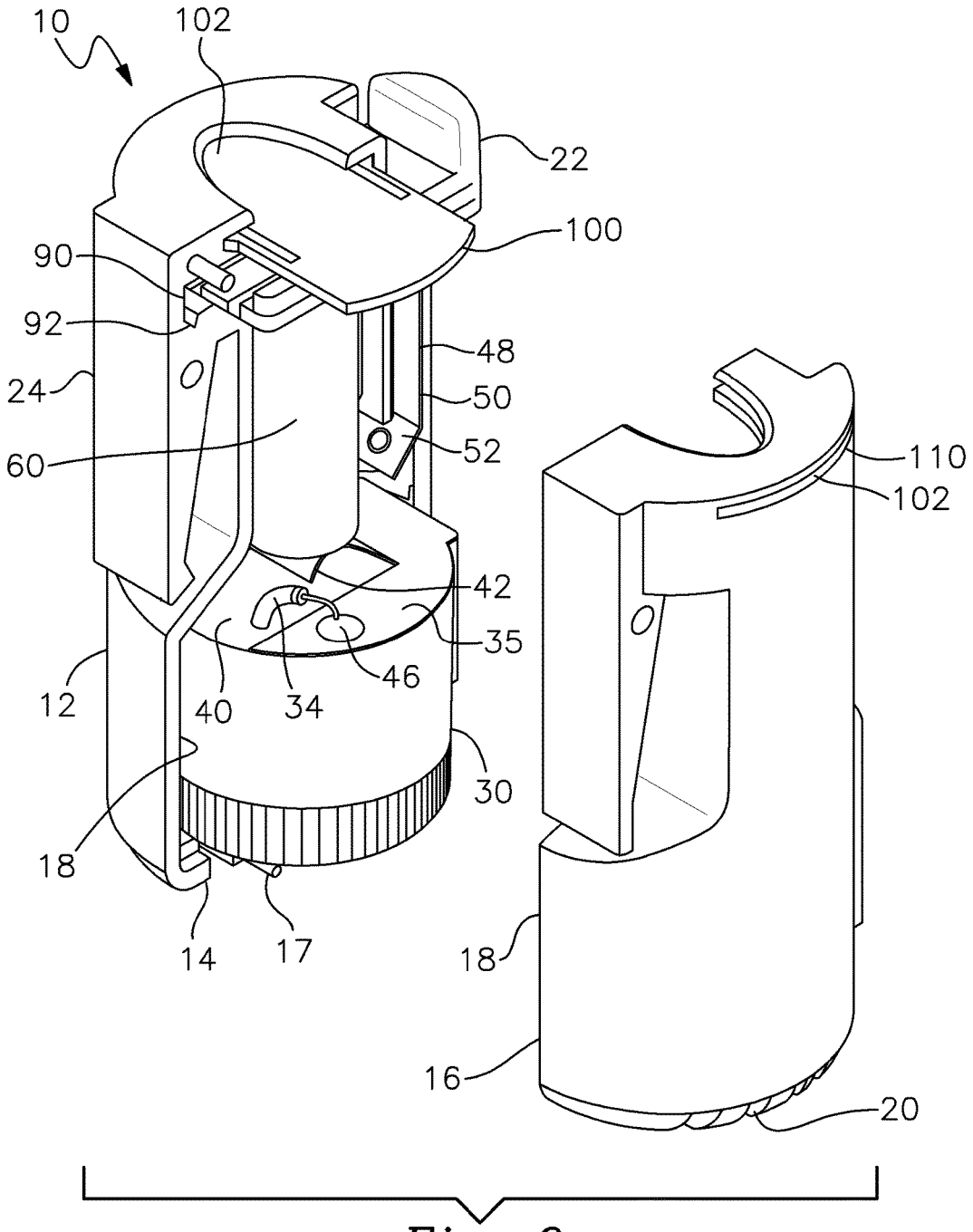
FIG. 6 is a perspective view of the assembly with half sections of the housing separated to depict the interior of the assembly.
Figure 7:
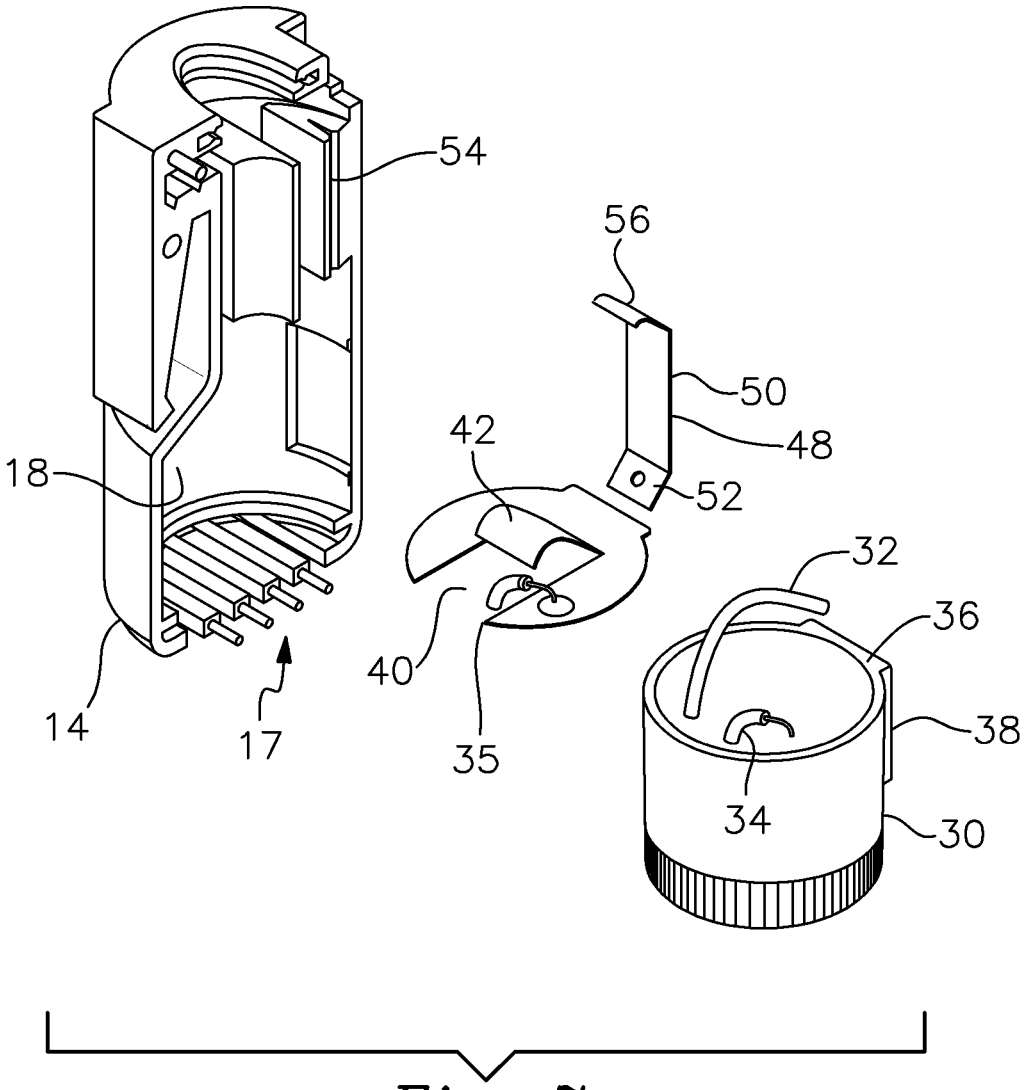
FIG. 7 is an exploded view of a portion of the assembly and particularly depicting the audible alarm device and the first and second alarm contacts, and indicating where these elements are supported in a half section of the housing.

As shown in FIGS. 6 and 7, housing 12 comprises the pair of molded half sections 14 and 16. As best represented in FIG. 7, each half section includes the interior chamber 18 for accommodating the various internal components of the panic alarm assembly. After the operating components of the assembly are installed within chamber 18, half sections 14 and 16 are snap fitted or otherwise secured together as shown in FIGS. 1-5 and as previously described.

As further shown in FIGS. 6 and 7, chamber 18 of housing 12 accommodates an audible alarm device, which may comprise a conventional piezo-electric siren 30 or other form of audible alarm that produces a piercing alarm signal appropriate for emergency situations. Other forms of sirens and audible alarms may be utilized. Siren 30 includes a positive wire lead 32 and a negative wire lead 34 that are electrically connected across the siren in such a manner that the siren may be operated by applying a voltage to the wire leads. Siren 30 has a generally cylindrical shape and fits snugly within a lower end of housing chamber 18 directly above the sound emitting slots 20 of housing 12.

Figure 11:
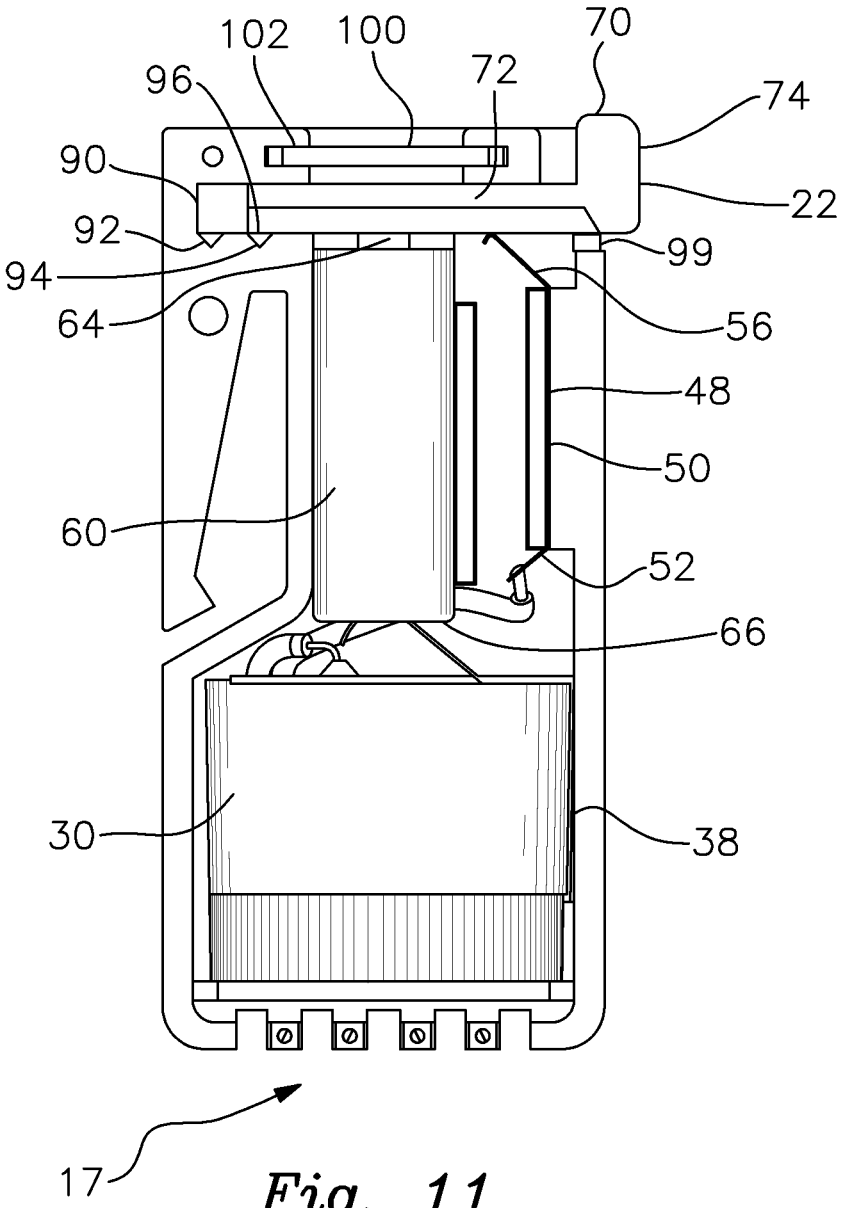
FIG. 11 is an elevational view of the interior of the alarm assembly.
Figure 12:
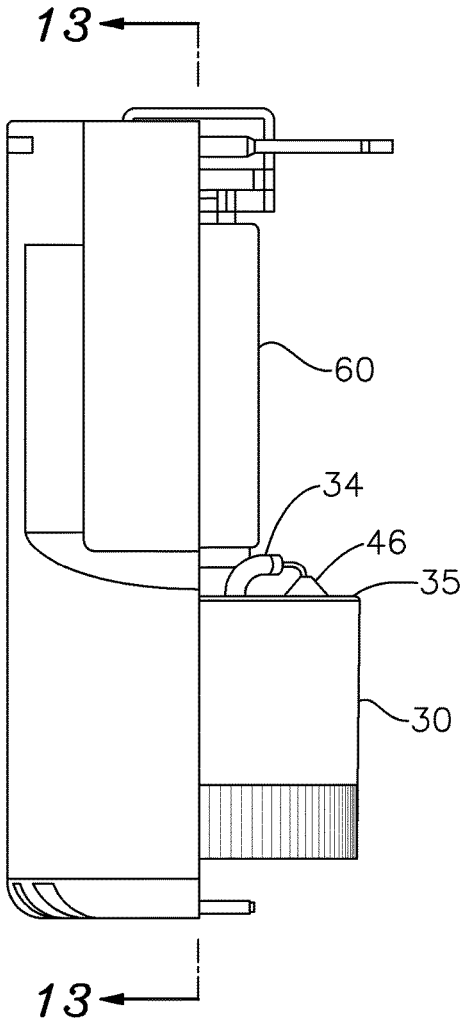
FIG. 12 is an elevational view of the assembly depicting a half section of the housing and the internal operating components of the assembly mounted therein.
Figure 13:
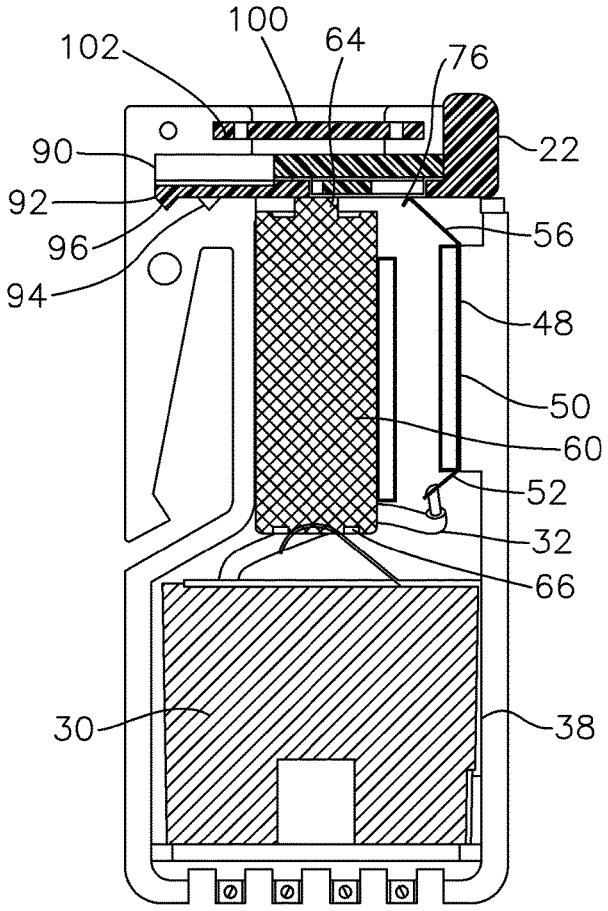
FIG. 13 is a cross sectional view taken along line 13-13 of FIG. 12.

A first alarm contact 35 is mounted on the upper surface of siren 30. More particularly, alarm contact 35 is held in place by a circular retainer ring 36 that is attached to siren 30 by an integral clip 38. This clip engages a side of siren 30 as shown in FIGS. 11 and 13. Contact 35 engages the top surface of siren 30 and is held in place by the retainer ring 36, which extends circumferentially about alarm contact 35. The first alarm contact includes a central slot 40 through which wire leads 32 and 34 of siren 30 extend when contact 35 is mounted on the top of siren 30. A spring contact arm 42 formed from a portion of alarm contact 35 is cut and raised upwardly from the remainder of contact 35 to effectively form slot 40. Wire lead 34 of the siren extends through slot 40 and is electrically connected to alarm contact 35 by solder 46.

When battery 60 is installed in housing 12, the lower or negative end of the battery engages the spring arm 42 of first alarm contact 35. The first alarm contact is thereby established as the negative contact for alarm device 30, which is connected thereto through wire lead 34.

Referring to FIGS. 6, 7, 11 and 13, a second alarm contact 48 is mounted within chamber 18 of housing 12 and electrically connected to siren 30. More particularly, second alarm contact 48 again includes an electrically conductive metal and specifically features an elongate contact portion 50 that is received within a thin mounting slot 54 (FIG. 7) formed in housing 12. One half of slot 54 is depicted in FIG. 7. It should be understood that a similarly configured thin slot is likewise formed in the other half section 16 of housing 12 for accommodating contact portion 50. Second alarm contact 50 also includes an angled lower end 52 that is electrically connected to wire lead 32 of siren 30. The opposite upper end second alarm of contact 48 is defined by a spring contact arm 56 that is unitarily connected to elongate portion 50 and extends upwardly at an angle relative thereto. Second alarm contact 48 is composed of an electrically conductive metal and the upper spring arm 56 may be resiliently compressed downwardly relative to elongate vertical contact portion 50.

The power source for panic alarm assembly 10 comprises a generally cylindrical battery 60 shown in FIGS. 6 and 10-13. This may comprise a 12-volt, 23 AMP battery or an alternative battery having other electrical capacities. Battery 60 includes a conventional pair of oppositely charged electrodes, namely a positive electrode 64 formed at the upper end of the battery and a negative electrode 66 formed at the opposite lower end thereof.

Figure 8:
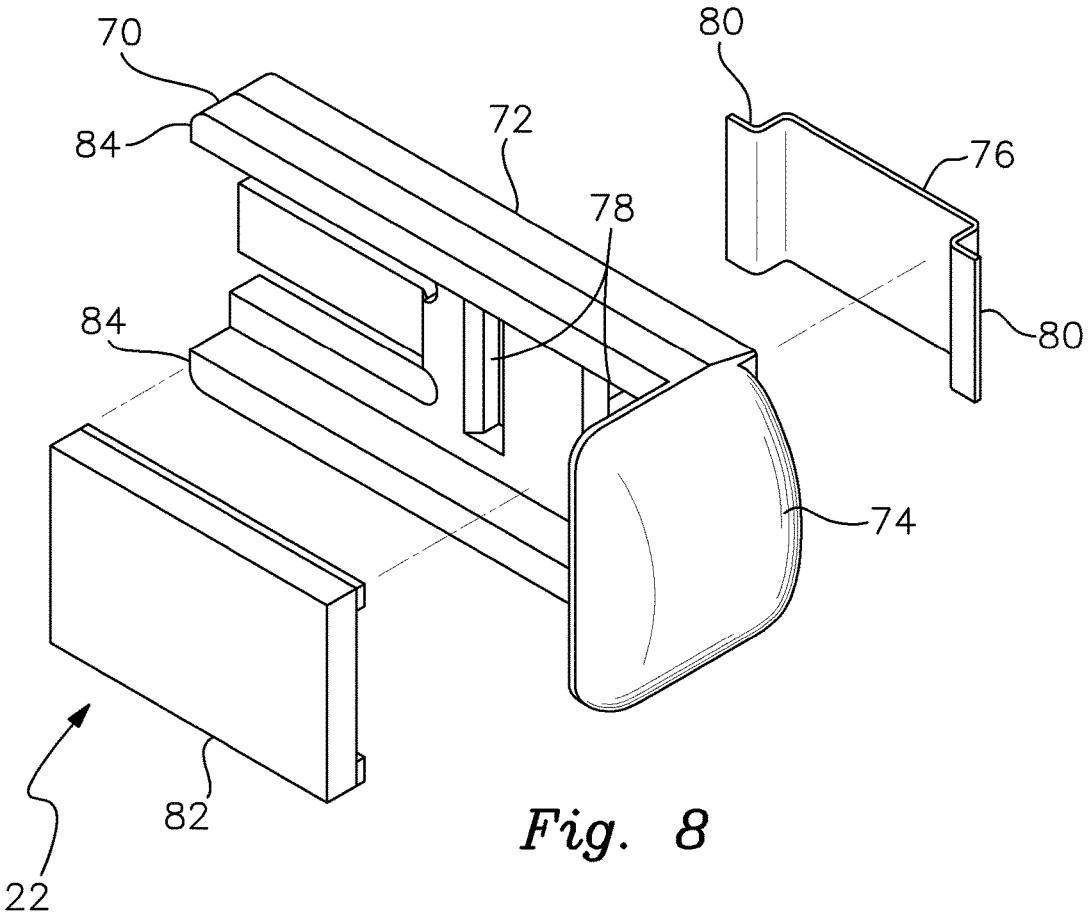
FIG. 8 is an exploded view of the actuator switch.

Actuator switch 22, which is shown alone in FIG. 8, includes a plastic actuator slide component 70 comprising an elongate carriage 72 and an actuator button 74 that is unitarily connected to an outer end of carriage 72. An actuator contact 76 composed of an electrically conductive metal plate is fastened to and supported by carriage 72. In particular, the carriage includes a pair of attachment slots 78 that receive respective L-shaped legs 80 of actuator contact 76. The legs 80 are snap-fit into slots 78 and actuator contact is thereby supported generally flush against a bottom surface of carriage 72. A retainer member 82 is then sonically welded to an upper surface of carriage 72 between an opposing pair of runners 84. This traps the legs of the actuator contact in place and thereby fastens the actuator contact securely to slide component 70.

Actuator switch 22 is operably mounted to body 12 of alarm assembly 10 in the manner best shown in FIGS. 6, 9, 11 and 13. In particular, housing 12 includes a transverse passageway 90 formed proximate an upper end of housing 12. A pair of switch retention notches 92 and 94 are formed proximate an inner end of transverse passageway 90. Notch 92 is formed in the bottom of transverse passageway 90 at the very inner or distal end of the transverse passageway and notch 94 is formed in the bottom surface of transverse passageway 90 outwardly from notch 92.

Carriage 72 of slide component 70 is received longitudinally through transverse passageway 90. As best shown in FIGS. 11 and 3, a distal end of carriage 72 includes a retention detent 96 depending therefrom. Detent 96 includes a generally tooth or triangular shape that corresponds to the shape of notches 92 and 94 such that the slide component is retained in a selected one of notches 92 and 94 during operation of the assembly as will be explained below.

Transverse passageway 90 and actuator switch 22 are positioned in assembly 10 such that actuator contact 76 is operably interengageable between battery electrode 64 and spring arm 56 of second alarm contact 48. In particular, as is explained below, actuator switch 22 may be alternated between an open condition, wherein actuator contact 76 engages only second alarm contact 48, and a closed position, wherein actuator contact electrically interengages both electrode 64 and second alarm contact 48. This allows the panic alarm assembly to be selectively activated and deactivated as needed.

The complementary sloped surfaces of detent 96 and notches 92, 94 facilitate selective engagement and disengagement of the detent and the notches. By the same token, the corresponding sloped shapes act to securely retain the detent in a selected notch so that the switch holds a corresponding "open"/"closed" state until the user decides to change the state of the switch by applying sufficient finger pressure to the actuator button to dislodge the detent from the notch.

An access opening 99, best shown in FIGS. 5 and 11 is formed at an entry of slot 90. This allows insertion of a tool to depress spring arm 56 and facilitate removal of actuator switch 22 when desired. This operation is described more fully below.

Figure 14:
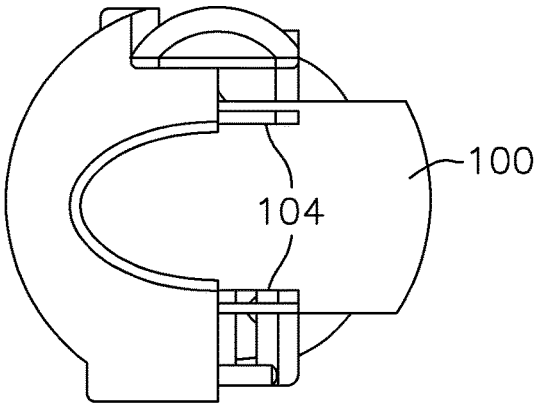
FIG. 14 is a top plan view of the assembly as shown in FIG. 12.
Figure 9:
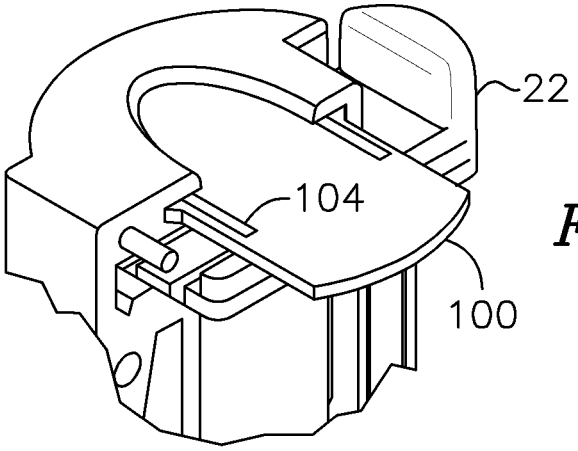
FIG. 9 is a top perspective view of a portion of the assembly and particularly depicting the actuator switch and battery cover as interengaged with the housing.

A battery cover 100, FIGS. 1, 2, 6 and 9-14 is received in an upper transverse slot 102 in housing 12 that is generally perpendicular to transverse passageway 90. Upper transverse slot 102 is disposed above transverse passageway 90 such that when battery cover 100 is received through the upper transverse slot 102 it is disposed slightly above actuator switch 22. As shown in FIGS. 9 and 14, cover 100 may include longitudinal tracks 104 that interengage complementary ribs formed in housing 12. This locks the cover in place, yet facilitates sliding removal of the cover when needed to replace the batteries. Such removal is described below.

As shown in FIGS. 1, 4 and 6, slot 102 may terminate in thin openings 110, which are aligned and formed respectively in the half sections 14 and 16 of housing 12. These aligned openings facilitate removal of the cover by allowing insertion of a thin coin such as a dime, which can be used to push cover 100 outwardly through the upper transverse slot 102.

Figure 10:
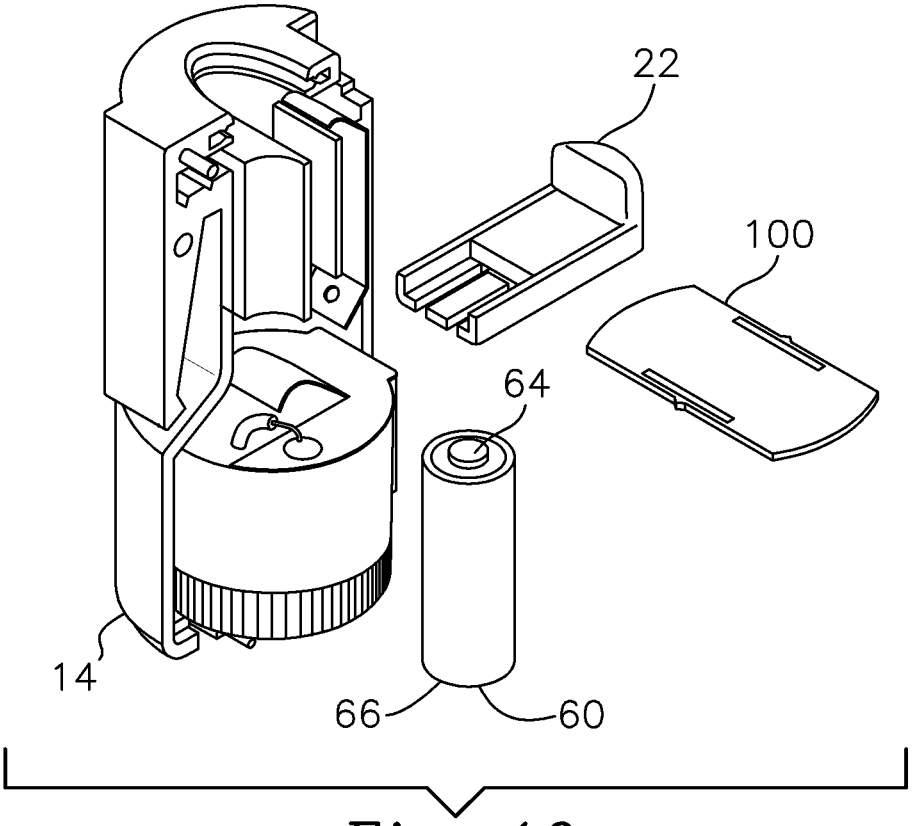
FIG. 10 is an exploded view of a half section of the housing with the alarm device inserted therein and further showing the battery, actuator switch and battery cover.

In operation, alarm assembly 10 is carried conveniently and discreetly by the user in an article of clothing or in virtually any accessory. (e.g. handbag, luggage, carrying case). In the deactivated condition, actuator switch 22 is opened so that the siren remains off and silent. This condition is depicted in FIGS. 9 and 10. Therein, actuator button 74 is pulled outwardly relative to housing 12 such that carriage 72 of slide component 70 is spaced apart from the inner end of transverse passageway 90. Detent 96 is thereby received in outer notch 94, which hold the actuator switch securely in an open and deactivated condition. In this condition, actuator contact 76 is disengaged from positive electrode 64. As a result, no power is provided to siren 30 through second alarm contact 48 and the siren remains silent.

In the event of an attack, intrusion or other emergency, the panic alarm assembly may be operated conveniently, reliably and continuously. The user simply grasps the cylindrical assembly in his or her hand and presses firmly against push button 74 of actuator switch 22. This causes slide component 70 to slide inwardly through transverse passageway 90. Detent 96 is pushed out of outer notch 94 (the complementary sloped surfaces of detent 96 and notch 94 facilitates the disengagement) and the detent slides inwardly until it is securely received by distal notch 92 of transverse passageway 90. Actuator contact 76, FIG. 13, thereby slides into contact with positive electrode 64 of battery 60. When electrical interconnection is established between positive electrode 64 and second alarm contact 48, the second alarm contact is effectively established as the positive contact for siren 30. Electrical interconnection is thereby established between the battery and spring arm 56 of the second or positive alarm contact 48. The electrical circuit is complete and power is supplied through contact 48 and wire lead 32 to activate the siren 30. A piercing alarm signal is emitted through slots 17 of housing 12.

When the panic alarm assembly is activated, it continues to sound until the actuator switch is opened. This must be accomplished by pulling actuator button 70 outwardly with enough pressure so that the actuator contact is disengaged from positive electrode 64. A firm, but not extreme finger pressure is required to perform this function. This will likely require some knowledge of the device and at least a brief amount of time to decipher. As a result, an attacker or intruder is apt to be frustrated from attempting to disable the battery and the emergency alarm. This improves the likelihood that an attack or intrusion will be thwarted.

A particular advantage of the panic alarm assembly of this invention is its ability to continuously operate without requiring the actuator switch to be held in a closed condition. This is accomplished by the distinctive retention mechanism comprising the cooperating detent and spaced notches. The interengagement between the detent and the distal notch effectively hold the actuator switch in a closed condition without the user having to continue to press the actuator button. As a result, the panic alarm assembly continues to operate in an unbroken fashion even if it is dropped, which is likely to happen during an unexpected attack or other emergency. Because the alarm assembly continues to operate, help and/or rescue is more apt to be effectively summoned to the scene.

The actuator switch construction serves as an improved reliable mechanical trigger for the panic alarm assembly. The notch and detent construction provide the user with readily defined and easy to discern open/ON and closed/OFF alarm states.

The battery employed in the panic alarm assembly is effectively concealed and cannot readily be removed by an attacker to disable the device. For the owner or user of the device to replace the battery, he or she may remove cover 100 by inserting a coin through the end of thin upper transverse slot 102 and pushing the cover outwardly through the opposite open end of the slot. Actuator switch 22 may then be removed from housing 12 by pulling button 74 and sliding carrier 72 outwardly from transverse passageway 90. A small screwdriver or other tool may be inserted through opening 99 and used to depress spring contact 56. This provides sufficient clearance so that detent 96 of the switch actuator is able to pass over the depressed spring contact 56. As a result, the carrier 72 of slide component 70 may be removed completely from the housing. Battery 60 may then be replaced as needed. Following battery replacement, switch actuator 22 and cover 100 are reinserted trough their respective transverse passageway 90 and upper transverse slot 102.

Panic alarm assembly 10 is compact and both quick and easy to operate. It remains activated without having to apply constant finger pressure. The assembly employs an uncomplicated and extremely reliable construction and serves effectively to produce a loud and continuous audible alarm during an attack or other emergency. The assembly is specifically designed to be conveniently portable and dependably operable for use in virtually any venue or for various emergency situations.

The panic alarm may be carried and effectively used by any man, woman or child requiring a dependable device to draw immediate attention to various types of emergencies. These include, but are not limited to, crimes being committed, medical incidents, accidents, attempted child abductions and other crises. For example, a child walking to a bus stop in the morning or returning home at night can conveniently carry and operate the panic alarm in the event of an attack or attempted abduction. Construction workers, road crew workers, landscapers and others who experience or encounter a workplace injury will find the alarm assembly to be a potentially invaluable and life-saving piece of equipment. A hiker, biker, jogger, hunter, boater or other person engaged in outdoor activities can easily carry the panic alarm and effectively utilize that device in the event that person is hurt in an accident or becomes lost. In all of these situations and in other emergencies, help can be promptly and successfully summoned by activating the panic alarm. The alarm is designed to be conveniently carried by the belt clip, on a child's backpack, by a purse strap or by a string or chain worn around the neck or wrist of the user. The device can also be conveniently stowed in almost any pocket or otherwise carried by the user.

It should be understood that various alternative electrical connections and polarity arrangements may be employed within the scope of this invention. Plastic and metal components of the type used in analogous devices may be employed although the particular materials of construction are not a limitation of this invention.

From the foregoing it may be seen that the apparatus of this invention provides for a portable panic alarm assembly. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. A portable panic alarm assembly comprising:

a housing that holds an electrically operated audible alarm device, said alarm device being electrically and operably interconnected between first and second alarm contacts;

a battery source mounted within said housing and including a pair of oppositely charged electrodes, a first one of said electrodes of said pair connected to said first alarm contact; and an actuator switch including a slide component mounted slidably in said housing and an actuator contact carried by said slide component, said actuator switch being selectively alternated between an open state wherein a second electrode of said pair is electrically disconnected from said second alarm contact to deactivate said alarm device and a closed state wherein said actuator contact electrically interconnects said second electrode and said second alarm contact to activate said alarm device; said slide component including an elongate slide carriage that is slidably received within a transverse passageway formed through said housing.

2. The assembly of claim 1 in which said first alarm contact is attached to said alarm device and extends across an upper surface thereof.

3. The assembly of claim 2 in which said alarm device includes a first wire lead that is electrically connected to said first alarm contact.

4. The assembly of claim 1 in which said first alarm contact includes a spring contact portion that extends upwardly from said first alarm contact for interengaging said first electrode of said battery.

5. The assembly of claim 1 in which said second alarm contact includes an elongate, electrically conductive contact portion that is received within a mounting slot formed interiorly within said housing.

6. The assembly of claim 5 in which said second alarm contact further includes an electrically conductive spring arm that extends upwardly from an upper end of said elongate electrically conductive contact portion at an angle thereto.

7. The assembly of claim 5 in which a lower end of said electrically conductive contact portion of said second alarm contact is electrically interconnected to a second wire lead of said alarm device.

8. The assembly of claim 1 in which an actuator button is attached integrally at an outer end of said carriage, said button being pressed by finger force to push said carriage transversely through said transverse passageway, said carriage being selectively pulled transversely outwardly through said passageway by pulling said actuator button outwardly from said housing.

9. The assembly of claim 1 in which said actuator contact includes a flat, electrically conductive plate and a pair of legs that are received in corresponding attachment slots formed in said carriage.

10. The assembly of claim 9 in which a retainer member is mounted to an upper surface of said carriage to hold said actuator contact in place with said flat conductive plate held flush against a bottom surface of said carriage.

11. The assembly of claim 1 in which said transverse passageway includes a pair of carried retention notches formed in a lower surface of said passageway proximate an inner end thereof.

12. The assembly of claim 11 in which said slide component includes a corresponding conformably shaped detent formed on a bottom surface of said slide carriage, said detent being received in an outermost said retention notch when said slidecomponent is pulled outwardly of said transverse passageway such that said actuator switch is held in place in an open state until actuating finger pressure is applied to push said actuator switch forwardly through said transverse passageway, which pressure causes said detent to slide out of said outermost notch and drives said carriage and said detent inwardly through said transverse passageway until said detent engages said second, innermost notch, whereby said actuator switch is held in place with said actuator contact operably interconnecting said second electrode to said second alarm contact such that said audible alarm remains activated until a user pulls said slide component outwardly by reengaging and pulling said actuator button outwardly of said transverse passageway.

13. The assembly of claim 12 in which said slide component is pulled outwardly by pulling said actuator button outwardly of said transverse passageway to pull said detent out of said innermost notch and drive said slide component slidably outwardly until said detent reengages said outermost notch, whereby said switch actuator is held in an open condition wherein said actuator contact disengages said second electrode of said battery and said alarm device is deactivated.

14. The assembly of claim 12 in which at least one of said second alarm contact and said housing is adapted to restrict removal of said detent from said transverse passageway and said housing, whereby said slide component and said switch actuator are restricted from being disconnected from said housing.

15. The assembly of claim 12 in which said second alarm contact includes an elongate contact portion that is received within a mounting slot formed interiorly within said housing, said second alarm contact further including a spring arm that extends upwardly from an upper end of said elongate element at an angle thereto, said transverse passageway including an entry aperture for introducing a tool into said housing, which tool is used to depress said spring arm so that said slide carriage and said detent may be removed past the depressed spring arm and through said entry aperture to fully remove said switch actuator from said housing.

16. The assembly of claim 1 further including a battery cover for selectively concealing and providing access to said battery source so that said battery source may be replaced as needed, and in which said housing includes an upper transverse slot formed transversely to and above said transverse passageway for receiving said battery cover.

17. A portable panic alarm assembly comprising:

a housing that holds an electrically operated audible alarm device, said alarm device being electrically and operably interconnected between first and second alarm contacts;

a battery source mounted within said housing and including a pair of oppositely charged electrodes, a first one of said electrodes connected to said first alarm contact; and an actuator switch including a slide component mounted slidably in said housing and an actuator contact carried by said slide component, said actuator switch being selectively alternated between an open state wherein a second electrode is electrically disconnected from said second alarm contact to deactivate said alarm device and a closed state wherein said actuator contact electrically interconnects said second electrode and said second alarm contact to activate said alarm device;

said first alarm contact being attached to said alarm device and extending across an upper surface thereof; said alarm device including a first wire lead that is electrically connected to said first alarm contact.

18. A portable panic alarm assembly comprising:

a housing that holds an electrically operated audible alarm device, said alarm device being electrically and operably interconnected between first and second alarm contacts;

a battery source mounted within said housing and including a pair of oppositely charged electrodes, a first one of said electrodes connected to said first alarm contact; and an actuator switch including a slide component mounted slidably in said housing and an actuator contact carried by said slide component, said actuator switch being selectively alternated between an open state wherein a second electrode is electrically disconnected from said second alarm contact to deactivate said alarm device and a closed state wherein said actuator contact electrically interconnects said second electrode and said second alarm contact to activate said alarm device;

said second alarm contact including an elongate contact portion that is received within a mounting slot formed interiorly within said housing.

19. The assembly of claim 18 in which said second alarm contact further includes a spring arm that extends upwardly from an upper end of said elongate contact portion at an angle thereto.

20. The assembly of claim 19 in which said actuator contact is supported such that said actuator contact is slidably engageable across said upper second electrode of said battery and said spring arm formed at said upper end of said second alarm contact, said slide component of said actuator switch including an elongate slide carriage that is slidably received within a transverse passageway through said housing, an actuator button being attached to an outer end of said slide carriage, said button being pulled and said slide carriage slid outwardly from said housing whereby a conductive plate of said actuator contact disengages said second electrode of said battery to deactivate said alarm device, said button being pressed and said side element pushed fully into said housing whereby said actuator contact interengages said second electrode and said second alarm contact to activate said alarm device.

* * * * *